US009850086B2

(12) United States Patent
Smeyers et al.

(10) Patent No.: US 9,850,086 B2
(45) Date of Patent: Dec. 26, 2017

(54) CONVEYOR MECHANISM AND A METHOD FOR ADJUSTING A CONVEYOR MECHANISM

(71) Applicant: OCE-TECHNOLOGIES B.V., Venlo (NL)

(72) Inventors: Johannes H. L. Smeyers, Venlo (NL); Antonius G. H. Albers, Venlo (NL); Roy H. R. Jacobs, Venlo (NL); Cornelius M. F. Janssen, Venlo (NL); Reinoldus F. Winarto, Venlo (NL); Ernest J. J. Clevers, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 4 days.

(21) Appl. No.: 14/943,823

(22) Filed: Nov. 17, 2015

(65) Prior Publication Data

US 2016/0137447 A1 May 19, 2016

(30) Foreign Application Priority Data

Nov. 18, 2014 (EP) ..... 14193722

(51) Int. Cl.
*B65H 5/02* (2006.01)
*B65H 7/20* (2006.01)
(Continued)

(52) U.S. Cl.
CPC ..... *B65H 7/20* (2013.01); *B65H 5/004* (2013.01); *B65H 5/021* (2013.01); *B65H 5/224* (2013.01);
(Continued)

(58) Field of Classification Search
CPC B65H 29/242; B65H 35/0006; B65H 29/686; B65H 29/56; B65H 29/243;
(Continued)

(56) References Cited

U.S. PATENT DOCUMENTS 3,889,801 A * 6/1975 Boyer ..... B65G 15/58 198/689.1
5,518,457 A * 5/1996 Seki ..... B31F 1/2831 474/102
(Continued)

FOREIGN PATENT DOCUMENTS

WO WO 2012/021059 2/2012

*Primary Examiner* — Thomas Morrison
(74) *Attorney, Agent, or Firm* — Birch, Stewart, Kolasch & Birch, LLP

(57) ABSTRACT

The present invention provides a conveyor mechanism for conveying sheets. The conveyor mechanism comprises a movable conveyor body, a drive mechanism, and an adjustment system configured to detect and correct skewing of the conveyor body, comprising one or more markers provided on or in the conveyor body, a sensor arrangement for detecting each marker at two or more discrete positions, and a processor to determine the skewing of the conveyor body. The conveyor body and the drive mechanism of the conveyor mechanism are mounted on a movable conveyor frame, and the adjustment system includes a frame shifting device comprising one or one or more actuator for shifting or moving the conveyor frame relative to a fixed framework. The invention also provides a related method of correcting skewing in a conveyor mechanism for conveying sheets along a transport path.

17 Claims, 5 Drawing Sheets

(51) Int. Cl.

| | |
|---|---|
| ***B65H 5/00*** | (2006.01) |
| ***B65H 5/22*** | (2006.01) |
| ***B65H 7/08*** | (2006.01) |
| ***B65H 9/00*** | (2006.01) |

(52) U.S. Cl.
CPC ..... *B65H 7/08* (2013.01); *B65H 9/002* (2013.01); *B65H 2404/2693* (2013.01); *B65H 2511/20* (2013.01); *B65H 2511/512* (2013.01); *B65H 2553/41* (2013.01); *B65H 2553/512* (2013.01); *B65H 2553/82* (2013.01); *B65H 2553/83* (2013.01); *B65H 2801/15* (2013.01)

(58) Field of Classification Search
CPC .... B65H 2511/20; B65H 5/004; B65H 5/021; B65H 5/224; B65H 7/20; B65H 7/08; B65H 9/002; B65H 2404/2693; B65H 2511/512; B65H 2553/41; B65H 2553/512; B65H 2553/82; B65H 2553/83; B65H 2801/15
USPC ..... 271/276, 196, 197, 275; 198/689.1, 198/810.03, 806, 807
See application file for complete search history.

(56) References Cited

U.S. PATENT DOCUMENTS

| | | | | |
|---|---|---|---|---|
| 6,607,458 | B2 * | 8/2003 | Downing | F16H 7/02 399/165 |
| 6,721,528 | B1 * | 4/2004 | Schreieder | G03G 15/755 198/807 |
| 7,905,346 | B2 * | 3/2011 | Enomoto | B41J 11/007 198/807 |
| 8,478,175 | B2 * | 7/2013 | Murai | G03G 15/168 198/810.02 |
| 8,672,323 | B2 * | 3/2014 | Blanchard | B41F 13/02 198/689.1 |
| 2003/0136646 | A1 | 7/2003 | Powell | |
| 2009/0196662 | A1 | 8/2009 | Boness et al. | |
| 2009/0202275 | A1 * | 8/2009 | Nishida | B41J 11/007 399/165 |
| 2009/0243200 | A1 * | 10/2009 | Chen | B65H 23/0326 271/227 |
| 2012/0328337 | A1 * | 12/2012 | Hiratsuka | G03G 15/1615 399/302 |
| 2013/0209750 | A1 * | 8/2013 | Van Berlo | B32B 37/0076 428/174 |

* cited by examiner

CONVEYOR MECHANISM AND A METHOD FOR ADJUSTING A CONVEYOR MECHANISM

FIELD OF THE INVENTION

The present invention relates to a conveyor mechanism comprising an adjustment system for correcting skewing of the conveyor mechanism for conveying or transporting sheets, especially sheets of a print medium in a printing system, such as an inkjet printing system. The present invention also relates to a printing system which includes such an adjustment system to improve and/or optimize productivity of the system. Furthermore, a method of adjusting a sheet conveyor mechanism to correct skewing of a conveyor body which conveys sheets along a transport path is provided.

BACKGROUND OF THE INVENTION

In many printing systems, such as inkjet printing systems, sheets of print medium to be printed are conveyed or transported by belt-type conveyor mechanisms. For example, such a belt-type conveyor mechanism will typically convey or transport the sheets to be printed into and through an image forming device or printing head of the printing system. To achieve high print quality in an inkjet printing system, the distance between the printing heads and the sheet to be printed is desirably kept small. Furthermore, to obtain optimum performance and output quality in a printing system, particularly an inkjet printing system, it is important to control the position of the sheets with respect to the printing heads of the image forming device very accurately. In this regard, an inkjet printing system aims to achieve micrometer accuracy in the positioning of ink droplets from the inkjet print heads operating at a fixed frequency.

It has been found that manufacturing tolerances and operating variations generally make it too difficult to provide a belt-type conveyor mechanism which operates at a sufficiently precise velocity and/or a reliably repeatable velocity for the level of accuracy desired in delivery of print medium sheets to an image forming device or to the printing heads in an inkjet printing system. To address this issue, a system has been developed which synchronizes operation of the image forming device or the printing heads with the movement of the conveyor mechanism. Accordingly, in developments to date, a system for operating the image forming device or inkjet printing heads based on movement of the conveyor drive mechanism has been proposed. This way, a precisely known constant speed or velocity of the conveyor mechanism should no longer be of primary relevance for accurate positioning of the ink droplets from the inkjet print heads. It has been found, however, that such a system still produces discrepancies or mismatches between the actual and the desired ink application.

US 2009/196662 A relates to a method of ensuring a correct lateral registration setting, in a digital multi-color electrographic sheet-printing machine, in which the sheets adhere to a support, preferably a transport belt, are transported past printing units.

SUMMARY OF THE INVENTION

It is therefore an object of the present invention is to provide a new and improved conveyor mechanism for conveying sheets of print medium along a transport path in a printing system which addresses this problem. It is also an object of the invention to provide a printing system or printing machine which includes such a conveyor mechanism.

In accordance with the invention, a conveyor mechanism comprising the features recited in claim 1 is provided for correcting skewing of a conveyor mechanism for conveying sheets along a transport path, especially sheets of print medium in a printing system. Preferred and/or advantageous features of the invention are recited in the dependent claims.

According to one aspect, therefore, the invention provides a conveyor mechanism which conveys sheets along a transport path, such as sheets of print medium in a printing system. The conveyor mechanism comprises a movable conveyor body configured to hold a plurality of sheets, such that movement of the conveyor body conveys the sheets along the transport path, and a drive mechanism which supports and/or drives movement of the conveyor body to convey the sheets along the transport path. The conveyor mechanism further comprises an adjustment system for correcting skewing of the conveyor mechanism. The adjustment system is configured to detect skewing of the conveyor body as it conveys the sheets along the transport path and comprises one or more markers which are provided on or in the conveyor body, and a sensor arrangement for sensing or detecting each marker at two or more discrete positions spaced apart from one another by a predefined distance along the transport path.

The adjustment system further includes a processor (e.g. a computer processor) for processing data or signals provided or generated by the sensor arrangement to detect and/or determine any skewing of the conveyor body as it conveys the sheets along the transport path.

The conveyor body and the drive mechanism of the conveyor mechanism are supported or mounted on a movable conveyor frame. The adjustment system for correcting skewing of the conveyor body may include a frame shifting device comprising one or more actuators for shifting or moving the conveyor frame relative to a fixed framework, such as a fixed framework of the printing system.

In this way, the inventors have provided an adjustment system with which skewing of the transport path of the sheets on the conveyor mechanism can be detected and corrected. In particular, the inventors have ascertained that the discrepancies or mismatches between the desired ink application and the actual ink application at the image forming device in a printing system can arise due to manufacturing tolerances, pollution effects, temperature effects, wear, as well as deformation of the conveyor body supported and/or driven by the drive mechanism, all of which may induce or cause skewing of the conveyor body. Thus, by sensing or detecting one or more markers provided on or in the conveyor body itself, the adjustment system is able to detect skewing which previously affected accurate printing. Once detected, the system also provides means for correcting that skewing.

In a preferred embodiment, the frame shifting device preferably includes one or more actuators, such as a servo motor, for driving movement of the conveyor frame, and especially pivoting movement or rotational movement of the conveyor frame, with respect to a reference axis. The movement of the conveyor frame is determined based on the data or signals from the sensor arrangement in relation to detected skewing of the conveyor body to compensate or correct for that detected skewing. The processor of the adjustment system is therefore configured to analyse the data or signals from the sensor arrangement to determine the degree of skewing based on a deviation of any of the markers with respect to the first or second skew sensing axes between the first and second sensor devices, and to control operation of the frame shifting device, especially the one or more actuator, based on the detected skewing to correct the skewing by pivoting or rotating the conveyor mechanism to the required degree about the reference axis. In this way, it can be ensured that the sheets conveyed by the conveyor body are delivered accurately without skewing to printing heads of an image forming device in the printing system.

In a preferred embodiment, the adjustment system includes a plurality of markers which are distributed or spaced apart along a length or extent of the conveyor body. Each marker is configured to be fixed with respect to the conveyor body. For example, each marker may comprise an aperture or a hole formed or provided in the conveyor body. Thus, the sensing or detecting a position of each marker with the sensor arrangement directly corresponds to sensing or detecting a position of the conveyor body itself. To this end, the sensor arrangement may comprise one or more optical sensors for sensing or detecting each marker. As the dimensions of the conveyor body itself cannot be guaranteed, e.g. due to thermal expansion, a comparative measurement system is provided. That is, the sensor arrangement is configured to sense or detect each marker at two (or more) discrete positions spaced apart from one another along the transport path by a predefined distance.

In a preferred embodiment, each marker is uniquely identifiable or distinguishable by the sensor arrangement. In this regard, for example, each of the plurality of markers may have its own characteristic shape or form. Alternatively or in addition, each of the plurality of markers may be distributed or spaced apart along a length or extent of the conveyor body at a unique spacing or distance, such that each marker is uniquely identifiable by the sensor arrangement. Where each marker comprises an aperture or hole formed in the conveyor body, for example, these measurement holes are not provided or arranged equidistantly to make unique identification of each hole possible. This enables a correct matching of the sensing or detecting measurements made at each position to the respective marker.

In a particularly preferred form of the invention, the conveyor mechanism is a belt-type conveyor mechanism, e.g. an endless belt conveyor mechanism, wherein the conveyor body comprises a belt member, e.g. an endless belt member. In the field of printing systems and printing machines, suction belt conveyor mechanisms are especially preferred. Thus, the conveyor mechanism may be configured to provide a suction or under-pressure to hold the sheets fixed in position on the conveyor body or belt member as it is moved to convey the sheets along the transport path. To this end, the conveyor body or belt member typically includes perforations or holes for communicating the suction or under-pressure to an outer surface (i.e. a carrier surface) of the belt member on which the sheets are supported. The belt member itself may be substantially stiff or rigid for high dimensional stability and for good wear properties. For example, the belt member may be comprised of steel and may optionally include a layer or coating of polymer material over the carrier surface thereof. The drive mechanism of the conveyor comprises rollers which support and/or drive the movement of the belt member to convey the sheets along the transport path. At least one of these rollers is typically a driven roller and thereby operatively connected to a drive motor for driving the movement of the belt member.

In a preferred embodiment of the invention, the sensor arrangement comprises a first sensor device provided at a first position for sensing or detecting each marker and a second sensor device provided at a second position for sensing or detecting each marker, with the first position and the second position being spaced apart from one another by the predefined distance along the transport path. As noted above, each of the first and second sensor devices is preferably an optical sensor device and is desirably suited to detecting a hole or aperture provided in the conveyor body or belt member. The first position of the first sensor device and the second position of the second sensor device are preferably provided on a frame member, which thus determines or sets the predefined distance between the first and second positions. To this end, the frame member is preferably comprised of a material that is substantially insensitive to temperature change. For example, the frame member may be comprised of a iron-nickel (FeNi) alloy known as "invar".

In a preferred embodiment, the first sensor device has a first skew sensing axis at the first position and the second sensor device has a second skew sensing axis at the second position. The first and second skew sensing axes are configured and arranged to extend generally parallel to the transport path and the first and second sensor devices are respectively configured to detect each marker with respect to the first and second skew sensing axes. That is, each of the first and second skew sensing axes provides a reference axis to assess skewing of the conveyor body or belt member as it moves between the first and second positions. A deviation of any one of the markers with respect to the first or second skew sensing axes between the first and second sensor devices is determined to represent a skewing of the conveyor body between the first and second positions.

In a particularly preferred embodiment, the sheet to be printed is a sheet of a print medium selected from the group comprised of: paper, polymer film, such as poly-ethylene (PE) film, polypropylene (PP) film, polyethylene terephthalate (PET) film, metallic foil, or a combination of two or more thereof. Paper is especially preferred as the print medium and each sheet of paper typically has a density in the range of 50 g to 350 g per square meter.

As explained above, the invention provides a conveyor mechanism for conveying sheets along a transport path, especially sheets of a print medium in a printing system, comprising:

- a movable conveyor body configured to hold one or more sheets, such that movement of the conveyor body conveys the sheets along the transport path,
- a drive mechanism which supports and/or drives the movement of the conveyor body to convey the sheets along the transport path; and
- an adjustment system according to any one of the embodiments described above, configured to detect and/or determine skewing of the conveyor body as it conveys the sheets along the transport path.

In a particularly preferred embodiment, the conveyor mechanism further includes a calibration system for calibrating the conveyor mechanism for synchronisation with a device for processing the sheets on the conveyor mechanism. In particular, the calibration system cooperates with the adjustment system for use in synchronising the conveyor body with the operation of a device that processes the sheets on the conveyor mechanism, especially an image forming device having one or more print heads. That is, the calibration system is configured for use in synchronising the movement of the sheet conveyor body with the operation of the print heads in the image forming device for printing an image on the sheets held on the conveyor body. To this end, the calibration system is configured to detect a position and/or a speed of the conveyor body as it conveys the sheets along the transport path and comprises the one or more markers provided on or in the conveyor body and the sensor arrangement for detecting each marker at two or more discrete positions spaced apart from one another by a predefined distance along the transport path. In this regard, however, the first sensor device includes a first speed sensing axis and the second sensor device includes a second speed sensing axis, wherein the first and second speed sensing axes extend transvers or generally perpendicular to the transport path. That is, the first sensor device has a first speed sensing axis at the first position and the second sensor device has a second speed sensing axis at the second position. The first and second sensor devices are respectively adapted to detect each marker with respect to the first and second speed sensing axes. In this regard, each of the first and second speed sensing axes provides a reference axis for determining the position and/or speed of the conveyor body or belt member as it moves between the first and second positions. Because the distance between the first position and the second position is fixed and predefined, detection of each uniquely identifiable marker at each of the first and second positions, together with a timer to record a time of each detection, readily allows for calculation and determination of the actual belt member speed. Preferably, therefore, the adjustment system includes a processor (e.g. computer processor) for processing data or signals provided or generated by the sensor arrangement, and particularly from each of the first and second sensor devices, to determine the position and/or speed of the conveyor body as it conveys the sheets along the transport path.

In a particularly preferred embodiment, where the conveyor mechanism comprises a belt-type conveyor mechanism, the calibration system comprises an encoder for converting a rotary position of at least one of the rollers of the drive mechanism to an electronic signal for correlation to the position and/or speed of the belt member. The encoder is thus preferably a rotary encoder which typically generates a high-frequency signal (e.g. about 360 kHz) and the encoder is desirably provided at the roller that best correlates with the movement of the belt, preferably via a frequency multiplier unit. The processor in the calibration system of the invention, however, is preferably configured to correct or to adjust a value of the position and/or speed of the belt member correlated from the encoder based on data or signals provided or generated by the sensor arrangement. In this regard, the data or signals provided or generated by the sensor arrangement may be processed to provide a correction table for the position and/or speed of the belt member correlated from the encoder. Thus, the processor preferably includes a correction table unit for correcting data or signals from the rotary encoder based on the data or signals from the sensor arrangement. The measurement (sensing or detecting) performed by the first and second sensor devices is typically at a much lower frequency (e.g. 100 Hz) than the rotary encoder provided in the drive mechanism of the conveyor.

According to a further aspect, the invention provides a printing system comprising a conveyor mechanism as described above for conveying sheets of print medium. The adjustment system is configured to detect and/or determine skewing of the conveyor body as it conveys the sheets along a transport path to an image forming device such that the skewing can be corrected for better alignment of the sheets with printing heads of the image forming device.

According to yet another aspect, the invention provides a method of calibrating a sheet conveyor mechanism for conveying sheets along a transport path, such as sheets of a print medium in a printing system, for synchronisation with a device for processing the sheets on the conveyor mechanism. The conveyor mechanism has a movable conveyor body configured to hold the sheets such that movement of the conveyor body conveys the sheets on the transport path, and a drive mechanism which supports and/or drives the movement of the conveyor body to convey the sheets along the transport path. In this aspect, the method comprises:

- providing one or more markers on or in the conveyor body and distributed or spaced apart along a length or extent of the conveyor body;
- sensing or detecting each marker at two or more discrete positions spaced apart from one another by a predefined distance along the transport path; and
- processing signals provided or generated by the sensor arrangement to detect and/or to determine skewing of the conveyor body as it conveys the sheets along the transport path; and
- moving a conveyor frame of the conveyor mechanism by pivoting or rotating the frame about a reference axis to correct the detected skewing.

In a preferred embodiment, the processing step comprises analysing the data or signals from the sensor arrangement to determine the skewing based on a deviation of any of the markers with respect to a first or a second skew sensing axis of the first and second sensor devices between first and second positions. In this regard, the first and second skew sensing axes of the first and second sensor devices extend generally parallel to the transport path.

As noted above, in a preferred embodiment the conveyor body comprises a belt member and the drive mechanism comprises rollers which support and/or drive the movement of the belt member to convey the sheets along the transport path. The conveyor body and the drive mechanism are desirably mounted or supported on a movable conveyor frame. In a preferred embodiment, therefore, the method includes moving the conveyor frame of the conveyor mechanism by pivoting or rotating that frame about a reference axis to correct the detected skewing. The method preferably further comprises: synchronising operation of a device for processing the sheets held on the conveyor body, e.g. an image forming device, with the conveyor body position determined in the processing step.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
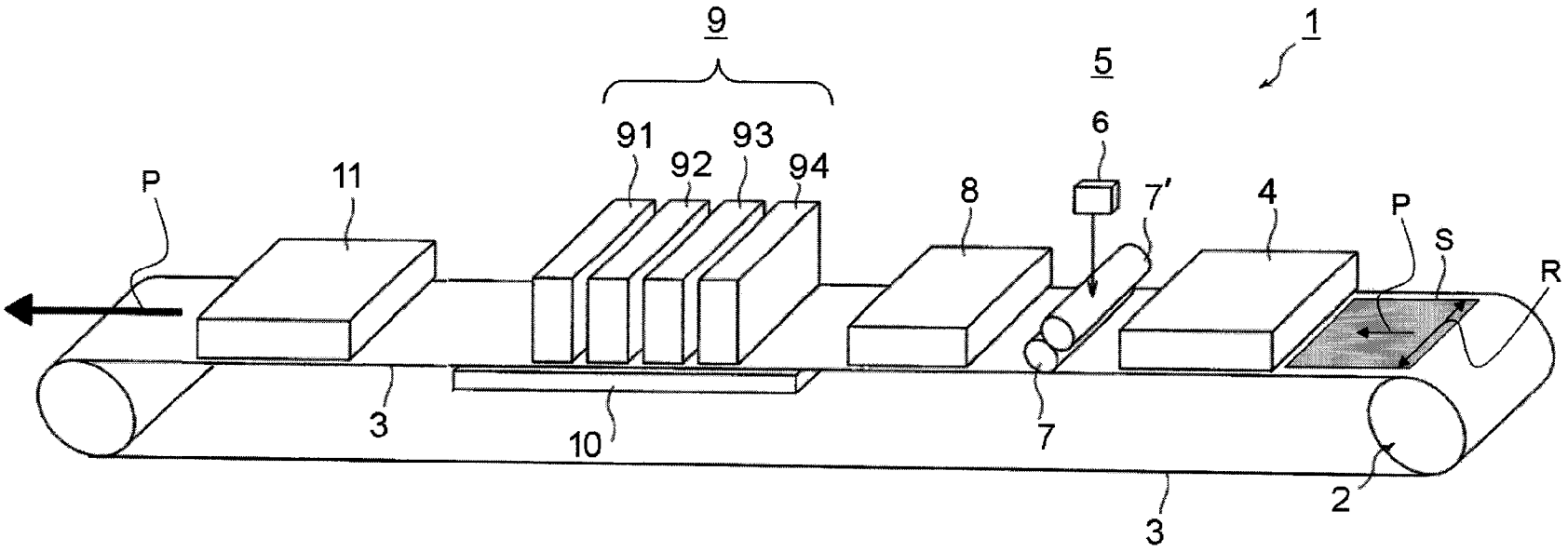
FIG. 1 is a schematic side view of part of a printing system according to an embodiment of the invention.

With reference to FIG. 1 of the drawings, a portion of an inkjet printing system 1 according to a preferred embodiment of the invention is shown. FIG. 1 illustrates in particular the following parts or steps of the printing process in the inkjet printing system 1: media pre-treatment, image formation, drying and fixing and optionally post treatment. Each of these will be discussed briefly below.

FIG. 1 shows that a sheet S of a receiving medium or print medium, in particular a machine-coated print medium, is transported or conveyed along a transport path P of the system 1 with the aid of conveyor mechanism 2 in a direction indicated by arrows P. The conveyor mechanism 2 may comprise a driven belt system having one or more endless belt 3. Alternatively, the belt(s) 3 may be exchanged for one or more drums 3. The conveyor mechanism 2 may be configured depending on the requirements of the sheet transport in each step of the printing process (e.g. sheet registration accuracy) and may hence comprise multiple driven belts and/or multiple drums 3. For proper conveyance of the sheets S of the receiving medium or print medium, the sheets S should be fixed to or held by the conveyor mechanism 2. The manner of such fixation is not limited but typically includes vacuum fixation (e.g. via suction or underpressure) although electrostatic fixation and/or mechanical fixation (e.g. clamping) may also be employed.

Media Pre-Treatment

To improve spreading and pinning (i.e. fixation of pigments and water-dispersed polymer particles) of the ink on the print medium, in particular on slow absorbing media, such as machine-coated media, the print medium may be pre-treated, i.e. treated prior to the printing of an image on the medium. The pre-treatment step may comprise one or more of the following:

(i) pre-heating of the print medium to enhance spreading of the ink used on the print medium and/or to enhance absorption into the print medium of the ink used;

(ii) primer pre-treatment for increasing the surface tension of print medium in order to improve the wettability of the print medium by the ink used and to control the stability of the dispersed solid fraction of the ink composition, i.e. pigments and dispersed polymer particles; (N.B. primer pre-treatment can be performed in a gas phase, e.g. with gaseous acids such as hydrochloric acid, sulphuric acid, acetic acid, phosphoric acid and lactic acid, or in a liquid phase by coating the print medium with a pre-treatment liquid. A pre-treatment liquid may include water as a solvent, one or more co-solvents, additives such as surfactants, and at least one compound selected from a polyvalent metal salt, an acid and a cationic resin); and (iii) corona or plasma treatment.

FIG. 1 illustrates that the sheet S of print medium may be conveyed to and passed through a first pre-treatment module 4, which module may comprise a preheater, (e.g. a radiation heater), a corona/plasma treatment unit, a gaseous acid treatment unit or a combination of any of these. Subsequently, a predetermined quantity of the pre-treatment liquid may optionally be applied on a surface of the print medium via a pre-treatment liquid applying device 5. Specifically, the pre-treatment liquid is provided from a storage tank 6 to the pre-treatment liquid applying device 5, which comprises double rollers 7, 7'. A surface of the double rollers 7, 7' may be covered with a porous material, such as sponge. After providing the pre-treatment liquid to auxiliary roller 7' first, the pre-treatment liquid is transferred to main roller 7, and a predetermined quantity is applied onto the surface of the print medium. Thereafter, the coated printing medium (e.g. paper) onto which the pre-treatment liquid was applied may optionally be heated and dried by a dryer device 8, which comprises a dryer heater installed at a position downstream of the pre-treatment liquid applying device 5 in order to reduce the quantity of water content in the pre-treatment liquid to a predetermined range. It is preferable to decrease the water content in an amount of 1.0 weight % to 30 weight % based on the total water content in the pre-treatment liquid provided on the print medium sheet S. To prevent the conveyor mechanism 2 from being contaminated with pre-treatment liquid, a cleaning unit (not shown) may be installed and/or the conveyor mechanism 2 may include a plurality of belts or drums 3, as noted above. The latter measure prevents or avoids contamination of other parts of the printing system 1, particularly of the conveyor mechanism 2 in the printing region.

It will be appreciated that any conventionally known methods can be used to apply the pre-treatment liquid. Specific examples of an application technique include: roller coating (as shown), ink-jet application, curtain coating and spray coating. There is no specific restriction in the number of times the pre-treatment liquid may be applied. It may be applied just one time, or it may be applied two times or more. An application twice or more may be preferable, as cockling of the coated print medium can be prevented and the film formed by the surface pre-treatment liquid will produce a uniform dry surface with no wrinkles after application twice or more. A coating device 5 that employs one or more rollers 7, 7' is desirable because this technique does not need to take ejection properties into consideration and it can apply the pre-treatment liquid homogeneously to a print medium. In addition, the amount of the pre-treatment liquid applied with a roller or with other means can be suitably adjusted by controlling one or more of: the physical properties of the pre-treatment liquid, the contact pressure of the roller, and the rotational speed of the roller in the coating device. An application area of the pre-treatment liquid may be only that portion of the sheet S to be printed, or an entire surface of a print portion and/or a non-print portion. However, when the pre-treatment liquid is applied only to a print portion, unevenness may occur between the application area and a non-application area caused by swelling of cellulose contained in coated printing paper with water from the pre-treatment liquid followed by drying. From a view-point of uniform drying, it is thus preferable to apply a pre-treatment liquid to the entire surface of a coated printing paper, and roller coating can be preferably used as a coating method to the whole surface. The pre-treatment liquid may be an aqueous liquid.

Corona or plasma treatment may be used as a pre-treatment step by exposing a sheet of a print medium to corona discharge or plasma treatment. In particular, when used on media such as polyethylene (PE) films, polypropylene (PP) films, polyethylene terephthalate (PET) films and machine coated media, the adhesion and spreading of the ink can be improved by increasing the surface energy of the medium. With machine-coated media, the absorption of water can be promoted which may induce faster fixation of the image and less puddling on the print medium. Surface properties of the print medium may be tuned by using different gases or gas mixtures as medium in the corona or plasma treatment. Examples of such gases include: air, oxygen, nitrogen, carbon dioxide, methane, fluorine gas, argon, neon, and mixtures thereof. Corona treatment in air is most preferred.

Image Formation

When employing an inkjet printer loaded with inkjet inks, the image formation is typically performed in a manner whereby ink droplets are ejected from inkjet heads onto a print medium based on digital signals. Although both single-pass inkjet printing and multi-pass (i.e. scanning) inkjet printing may be used for image formation, single-pass inkjet printing is preferable as it is effective to perform high-speed printing. Single-pass inkjet printing is an inkjet printing method with which ink droplets are deposited onto the print medium to form all pixels of the image in a single passage of the print medium through the image forming device, i.e. beneath an inkjet marking module.

Referring to FIG. 1, after pre-treatment, the sheet S of print medium is conveyed on the transport belt 3 to an image forming device or inkjet marking module 9, where image formation is carried out by ejecting ink from inkjet marking device 91, 92, 93, 94 arranged so that a whole width of the sheet S is covered. That is, the image forming device 9 comprises an inkjet marking module having four inkjet marking devices 91, 92, 93, 94, each being configured and arranged to eject an ink of a different colour (e.g. Cyan, Magenta, Yellow and Black). Such an inkjet marking device 91, 92, 93, 94 for use in single-pass inkjet printing typically has a length corresponding to at least a width of a desired printing range R (i.e. indicated by the double-headed arrow on sheet S), with the printing range R being perpendicular to the media transport direction along the transport path P.

Figure 2:
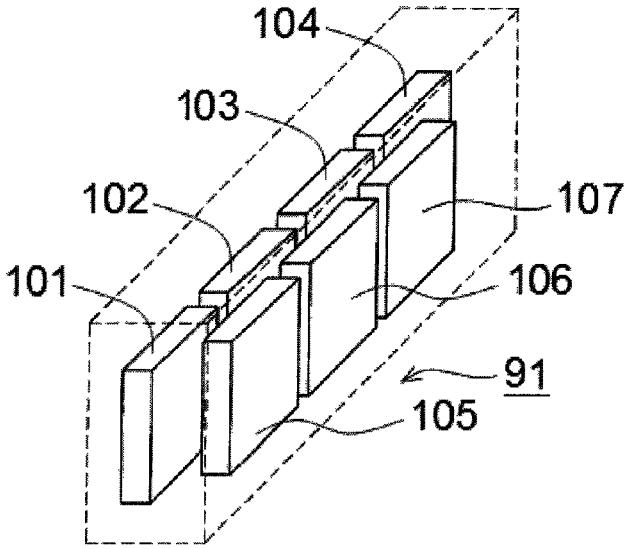
FIG. 2 is a schematic perspective view of an image forming device in the printing system of FIG. 1.
Figure 3A:
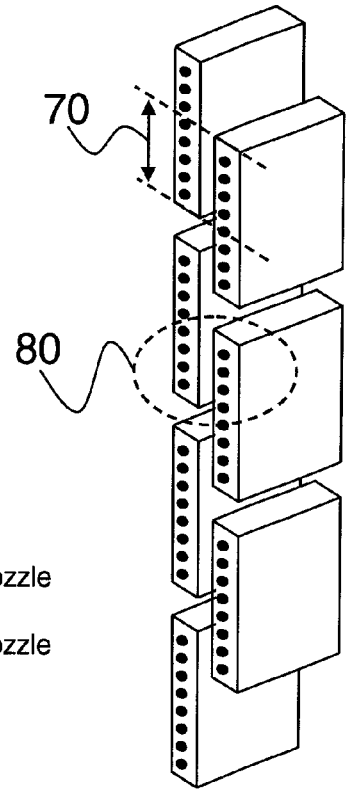
FIG. 3A is a schematic perspective underside view of printing heads in the image forming device of FIG. 2.
Figure 3B:
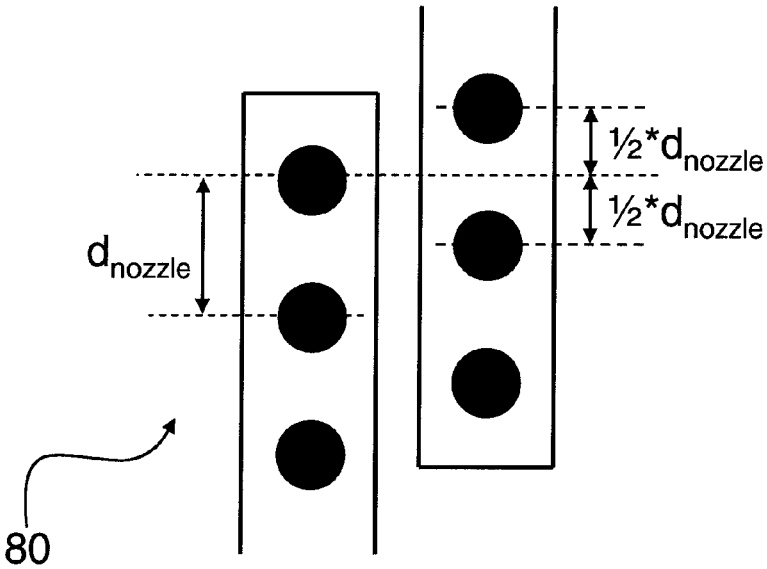
FIG. 3B is a detailed view of the printing heads in the image forming device of FIG. 2 and FIG. 3A.

Each inkjet marking device 91, 92, 93, 94 may have a single print head having a length corresponding to the desired printing range R. Alternatively, as shown in FIG. 2, the inkjet marking device 91 may be constructed by combining two or more inkjet heads or printing heads 101-107, such that a combined length of individual inkjet heads covers the entire width of the printing range R. Such a construction of the inkjet marking device 91 is termed a page wide array (PWA) of print heads. As shown in FIG. 2, the inkjet marking device 91 (and the others 92, 93, 94 may be identical) comprises seven individual inkjet heads 101-107 arranged in two parallel rows, with a first row having four inkjet heads 101-104 and a second row having three inkjet heads 105-107 arranged in a staggered configuration with respect to the inkjet heads 101-104 of the first row. The staggered arrangement provides a page-wide array of inkjet nozzles 90, which nozzles are substantially equidistant in the length direction of the inkjet marking device 91. The staggered configuration may also provide a redundancy of nozzles in an area O where the inkjet heads of the first row and the second row overlap. (See in FIG. 3A). The staggering of the nozzles 90 may further be used to decrease an effective nozzle pitch d (and hence to increase print resolution) in the length direction of the inkjet marking device 91. In particular, the inkjet heads are arranged such that positions of the nozzles 90 of the inkjet heads 105-107 in the second row are shifted in the length direction of the inkjet marking device 91 by half the nozzle pitch d, the nozzle pitch d being the distance between adjacent nozzles 90 in an inkjet head 101-107. (See FIG. 3B, which shows a detailed view of 80 in FIG. 3A). The nozzle pitch d of each head is, for example, about 360 dpi, where "dpi" indicates a number of dots per 2.54 cm (i.e. dots per inch).

The resolution may be further increased by using more rows of inkjet heads, each of which are arranged such that the positions of the nozzles of each row are shifted in the length direction with respect to the positions of the nozzles of all other rows.

In the process of image formation by ejecting ink, an inkjet head or a printing head employed may be an on-demand type or a continuous type inkjet head. As an ink ejection system, an electrical-mechanical conversion system (e.g. a single-cavity type, a double-cavity type, a bender type, a piston type, a shear mode type, or a shared wall type) or an electrical-thermal conversion system (e.g. a thermal inkjet type, or a Bubble Jet® type) may be employed. Among them, it is preferable to use a piezo type inkjet recording head which has nozzles of a diameter of 30 μm or less in the current image forming method.

The image formation via the inkjet marking module 9 may optionally be carried out while the sheet S of print medium is temperature controlled. For this purpose, a temperature control device 10 may be arranged to control the temperature of the surface of the conveyor mechanism 2 (e.g. belt or drum 3) below the inkjet marking module 9. The temperature control device 10 may be used to control the surface temperature of the sheet S within a predetermined range, for example in the range of 30° C. to 60° C. The temperature control device 10 may comprise one or more heaters, e.g. radiation heaters, and/or a cooling means, for example a cold blast, in order to control and maintain the surface temperature of the print medium within the desired range. During and/or after printing, the print medium is conveyed or transported downstream through the inkjet marking module 9.

Drying and Fixing

After an image has been formed on the print medium, the printed ink must be dried and the image must be fixed on the print medium. Drying comprises evaporation of solvents, and particularly those solvents that have poor absorption characteristics with respect to the selected print medium.

FIG. 1 of the drawings schematically shows a drying and fixing unit 11, which may comprise one or more heater, for example a radiation heater. After an image has been formed on the print medium sheet S, the sheet S is conveyed to and passed through the drying and fixing unit 11. The ink on the sheet S is heated such that any solvent present in the printed image (e.g. to a large extent water) evaporates. The speed of evaporation, and hence the speed of drying, may be enhanced by increasing the air refresh rate in the drying and fixing unit 11. Simultaneously, film formation of the ink occurs, because the prints are heated to a temperature above the minimum film formation temperature (MFT). The residence time of the sheet S in the drying and fixing unit 11 and the temperature at which the drying and fixing unit 11 operates are optimized, such that when the sheet S leaves the drying and fixing unit 11 a dry and robust image has been obtained.

As described above, the conveyor mechanism 2 in the fixing and drying unit 11 may be separate from the conveyor mechanism 2 of the pre-treatment and printing parts or sections of the printing system 1 and may comprise a belt and/or a drum. Preferably, the conveyor mechanism 2 in the fixing and drying unit 11 comprises a drum and includes a device, such as one or more fan, especially a centrifugal fan, for generating an under-pressure or suction for holding a plurality of sheets of print medium in contact with an outer periphery of the drum 3. Further details of this embodiment of the conveyor mechanism 2 in the fixing and drying unit 11 will be described later.

Post Treatment

To improve or enhance the robustness of a printed image or other properties, such as gloss level, the sheet S may be post treated, which is an optional step in the printing process. For example, in a preferred embodiment, the printed sheets S may be post-treated by laminating the print image. That is, the post-treatment may include a step of applying (e.g. by jetting) a post-treatment liquid onto a surface of the coating layer, onto which the ink has been applied, so as to form a transparent protective layer over the printed recording medium. In the post-treatment step, the post-treatment liquid may be applied over the entire surface of an image on the print medium or it may be applied only to specific portions of the surface of an image. The method of applying the post-treatment liquid is not particularly limited, and may be selected from various methods depending on the type of the post-treatment liquid. However, the same method as used in coating the pre-treatment liquid or an inkjet printing method is preferable. Of these, an inkjet printing method is particularly preferable in view of: (i) avoiding contact between the printed image and the post-treatment liquid applicator; (ii) the construction of an inkjet recording apparatus used; and (iii) the storage stability of the post-treatment liquid. In the post-treatment step, a post-treatment liquid containing a transparent resin may be applied on the surface of a formed image so that a dry adhesion amount of the post-treatment liquid is 0.5 g/m$^2$ to 10 g/m$^2$, preferably 2 g/m$^2$ to 8 g/m$^2$, thereby to form a protective layer on the recording medium. If the dry adhesion amount is less than 0.5 g/m$^2$, little or no improvement in image quality (image density, colour saturation, glossiness and fixability) may be obtained. If the dry adhesion amount is greater than 10 g/m$^2$, on the other hand, this can be disadvantageous from the view-point of cost efficiency, because the dryness of the protective layer degrades and the effect of improving the image quality is saturated.

As a post-treatment liquid, an aqueous solution comprising components capable of forming a transparent protective layer over the print medium sheet S (e.g. a water-dispersible resin, a surfactant, water, and other additives as required) is preferably used. The water-dispersible resin in the post-treatment liquid preferably has a glass transition temperature (Tg) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin is preferably radiation curable to improve the glossiness and fixability of the image. As the water-dispersible resin, for example, any one or more of an acrylic resin, a styrene-acrylic resin, a urethane resin, an acryl-silicone resin, a fluorine resin or the like, is preferably employed. The water-dispersible resin can be suitably selected from the same materials as that used for the inkjet ink. The amount of the water-dispersible resin contained, as a solid content, in the protective layer is preferably 1% by mass to 50% by mass. The surfactant used in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus, as shown in FIG. 1. However, the printing system 1 and the associated printing process are not restricted to the above-mentioned embodiment. A system and method are also contemplated in which two or more separate machines are interconnected through a conveyor mechanism 2, such as a belt conveyor 3, drum conveyor or a roller, and the step of applying a pre-treatment liquid, the (optional) step of drying a coating solution, the step of ejecting an inkjet ink to form an image and the step or drying an fixing the printed image are performed separately. Nevertheless, it is still preferable to carry out the image formation with the above defined in-line image forming method and printing system 1.

Figure 4:
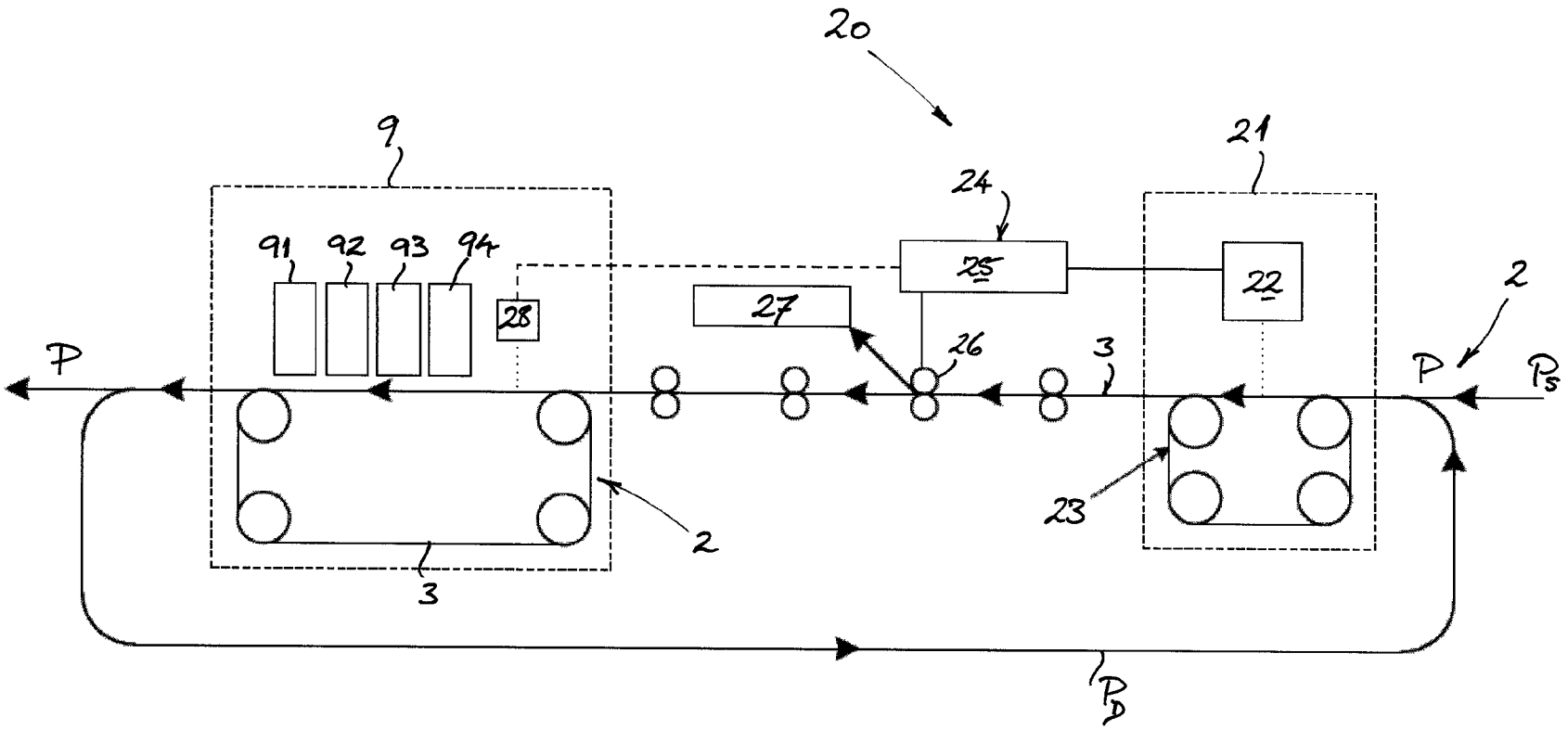
FIG. 4 is a schematic side view of a printing system with a defect detection system according to an embodiment of the invention.

With reference now to FIG. 4 of the drawings, the inkjet printing system 1 according to the preferred embodiment of the invention is shown to include an apparatus 20 for detecting defects in the printing system 1, and particularly for identifying and for classifying deformations D in the sheets S of print medium when the sheets S are on the transport path P of the printing system 1. In this particular embodiment, the apparatus 20 comprises a sensing unit 21, which processes the sheets S on the transport path P before those sheets S enter the image forming device 9. In this regard, it will be noted that the printing system 1 in FIG. 4 has a transport path P which includes both a simplex path $P_S$ and a duplex path $P_D$ and the sensing unit 21 of the apparatus 20 is arranged such that sheets S input on the simplex path $P_S$ and also returning on the duplex path $P_D$ all pass via the sensing unit 21.

At least one first sensor device 22 in the form of an optical sensor, such as a laser scanner, is provided within the sensing unit 21 for sensing the surface geometry or topology of the sheets S as they travel on a first pass or a second pass along the transport path P. The laser scanner or optical sensor device 22 generates digital image data I of the three-dimensional surface geometry or topology of each sheet S sensed or scanned. When performing the sensing or measuring of the surface geometry or topology of the sheets S on the transport path P of printing system 1 with the first sensor device(s) 22, it is highly desirable for the purposes of accuracy and reliability that the sheets S are transported or conveyed in the sensing unit 21 in substantially the same manner as those sheets S are later transported in the image forming unit or marking module 9. To this end, the sensing unit 21 includes a sheet conveyor mechanism 23 configured to simulate sheet transport conditions provided by the conveyor mechanism 2 within the image forming unit 9. In this regard, both the conveyor mechanism 23 in the sensing unit 21 and the conveyor mechanism 2 in the image forming unit 9 include a belt transport device with vacuum sheet-holding pressure, as seen in FIG. 4.

The sheet topology data from the first sensor device 22 is then transmitted (e.g. either via a cable connection or wirelessly) to a controller 24 which includes a processor device 25 for processing and analysing the digital image data I to detect and to classify any defect or deformation D in the surface geometry or topology of each sheet S sensed or scanned. The sensing unit 21 is thus arranged to scan the sheets S for detecting and measuring any deformations or defects D before the sheets S enter the image forming device or inkjet marking module 9. In this way, if the processor device 25 determines that a sheet S on the transport path P includes a defect or deformation D that would render the sheet unsuitable for printing, the controller 24 is configured to prevent the sheet S from progressing to the inkjet marking module 9. The sensing unit 21 comprising the first sensor device(s) 22 is therefore desirably provided as a separate sentry unit positioned on the transport path P sufficiently upstream of the marking module 9. The controller 24 and processor device 25 may be integrated within the sentry unit 21 or they may be separately or remotely located.

Conveyor Mechanism

Figure 5:
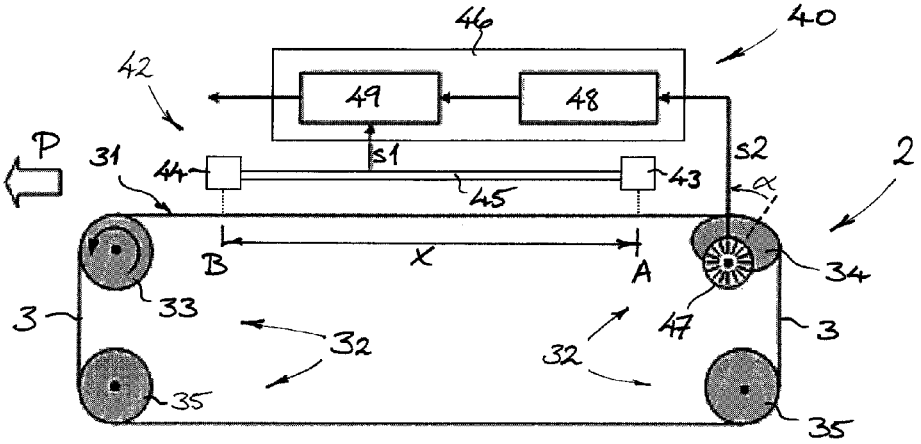
FIG. 5 is a schematic side view of a conveyor device for conveying sheets and having a calibration system according to a preferred embodiment of the invention.
Figure 6:
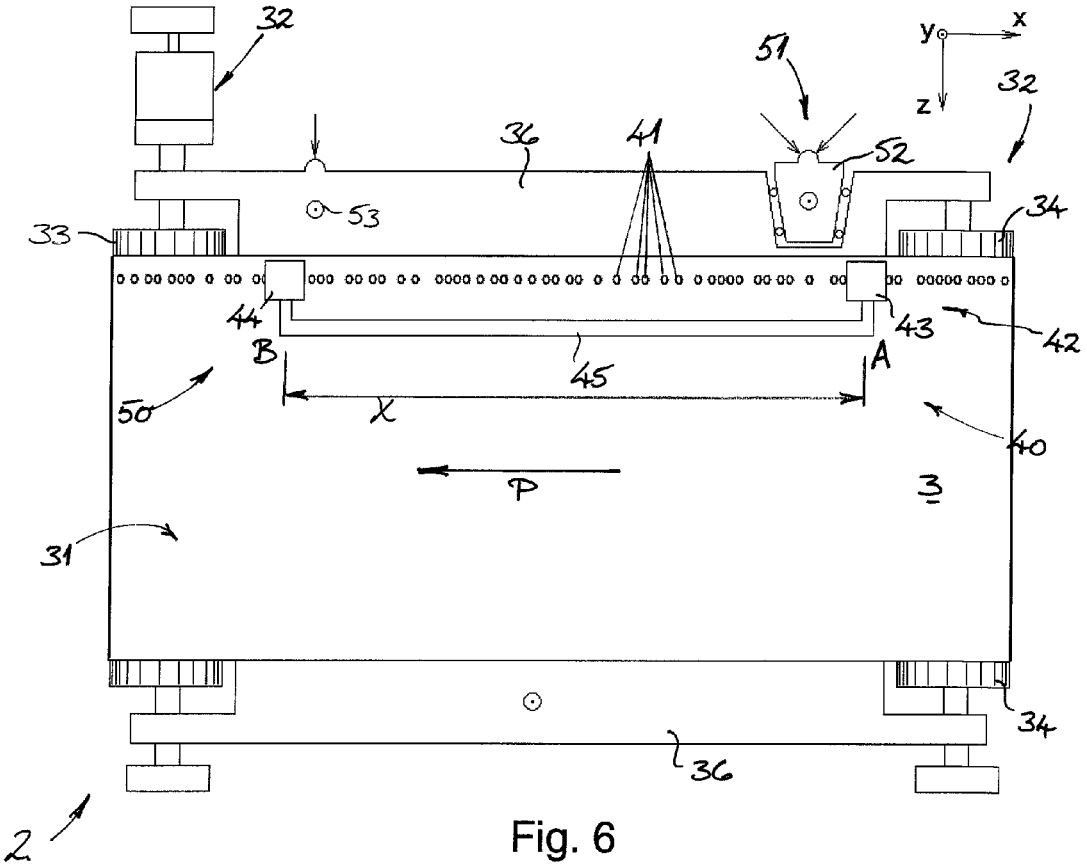
FIG. 6 is a top or plan view of the conveying device illustrated schematically in FIG. 5.

With reference now to FIG. 5 and FIG. 6 of the drawings, a conveyor mechanism 2 according to a preferred embodiment of the invention is illustrated. This conveyor mechanism 2 is particularly configured as the conveyor mechanism 2 within the image forming unit 9, seen in FIG. 4. As mentioned, this conveyor mechanism 2 is a belt-type conveyor mechanism and thus includes a movable conveyor body 3 provided in the form of a belt member, e.g. an endless belt member, having an outer surface 31 for carrying the sheets S to be printed. As the sheets S should be held fixed in position and flat upon the belt member 3 as they are conveyed to the inkjet marking devices 91-94, the conveyor mechanism 2 is configured to provide a suction or under-pressure to hold the sheets fixed on the belt member 3 as it is moved to convey the sheets along the transport path P. To this end, the conveyor belt member 3 typically includes perforations or holes (not shown) to communicate the suction or under-pressure to the outer surface 31 of the belt member on which the sheets are supported. The belt member 3 is substantially stiff or rigid and is comprised of steel for high dimensional stability and for good wear properties.

The conveyor mechanism 2 includes a drive mechanism 32 comprising rollers 33, 34, 35 which support and/or drive the movement of the belt member 3 to convey the sheets S along the transport path P. In this regard, one roller 33 is operatively connected to a drive motor and thus forms a driven roller for driving the circulating movement of the belt member 3. Another roller 34 has a fixed axis and therefore closely follows movement of the belt member 3. The lower rollers 35 are mounted to exert a resilient bias against the belt member 3 and have movable axes in order to maintain a desired of tension in the belt member 3, regardless of any thermal expansion or contraction in the belt member 3.

To achieve high quality printing in this printing system 1, it is important to control the position of the sheets S with respect to the inkjet marking devices 91-94 of the image forming unit 9 very accurately. For this purpose, the conveyor mechanism 2 includes a calibration system 40 for calibrating the conveyor mechanism 2, and in particular the conveyor body or belt member 3, for synchronization with operation of the inkjet marking devices 91-94 of the image forming unit 9. In this regard, the calibration system 40 is configured to precisely detect a position and/or a speed of the belt member 3 as it conveys the sheets S along the transport path P. This way, a precise or accurate positioning of the ink droplets from the inkjet heads (i.e. at micrometer level) can be realized in spite of manufacturing tolerances, pollution or contamination effects, temperature effects such as thermal expansion in the belt member 3, and wear or deformation in the belt member 3 or the rollers 33, 34, 35.

The calibration system 40 comprising a plurality of markers 41 which are provided as holes formed in the belt member 3 and a sensor arrangement 42 for detecting each marker 41 at two discrete positions A, B spaced apart from one another by a predefined distance X along the transport path P. Each of the marker holes 41 is distributed or spaced apart along a length or extent of the conveyor belt member 3 at a unique spacing or distance, such that each marker hole 41 is uniquely identifiable by the sensor arrangement 42. The sensor arrangement 42 comprises a first sensor device 43 provided at a first position A for sensing or detecting each marker 41 and a second sensor device 44 provided at a second position B for sensing or detecting each marker 41, with the first position A and the second position B being spaced apart from one another by the predefined distance X along the transport path P. In this regard, each of the first and second sensor devices 43, 44 is an optical sensor device and is suited to detecting a hole 41 provided in the conveyor body or belt member 3. The sensor devices 43, 44 are mounted at opposite ends of an elongate frame member 45 provided in the form of a rod or beam. In this way, the frame member 45 effectively defines the first and second positions A, B and determines or sets the predefined distance X between those first and second positions A, B. To avoid variations in this distance X, the frame member 45 is comprised of an iron-nickel (FeNi) alloy known as "inver" that is substantially insensitive to temperature change.

Figure 8:
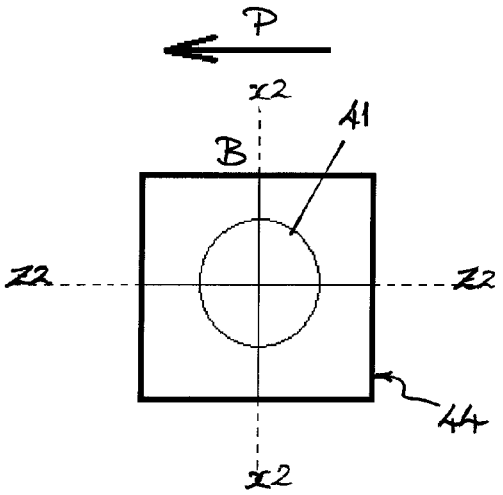
FIG. 8 is a schematic underside view of a second sensor device of a sensor arrangement in the calibration system of the preferred embodiment.
Figure 7:
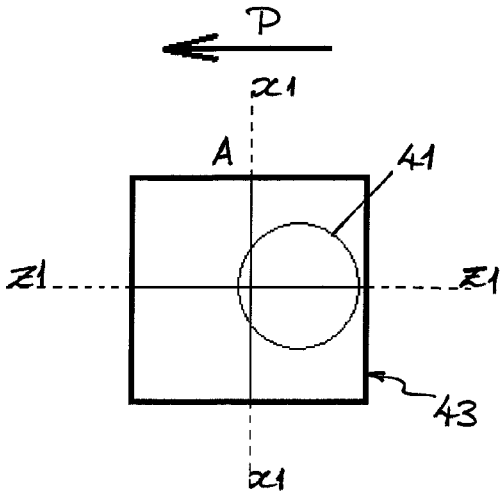
FIG. 7 is a schematic underside view of a first sensor device of a sensor arrangement in the calibration system of the preferred embodiment of the invention.
Figure 10:
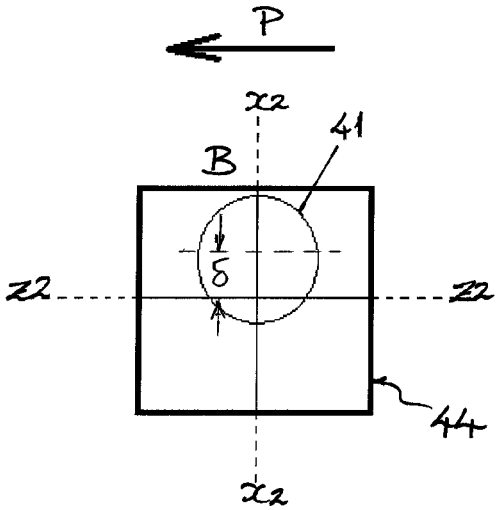
FIG. 10 is a schematic underside view of a second sensor device of a sensor arrangement in an adjustment system of the preferred embodiment of the invention.
Figure 9:
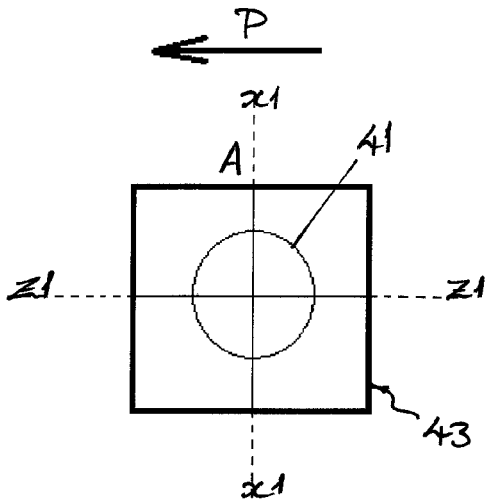
FIG. 9 is a schematic underside view of a first sensor device of a sensor arrangement in an adjustment system of the preferred embodiment of the invention.

Referring also now to FIGS. 7 and 8 of the drawings, the first sensor device 43 has a first speed sensing axis x1 at the first position A and the second sensor device 44 has a second speed sensing axis x2 at the second position B. The first and second speed sensing axes x1, x2 substantially perpendicular to the transport path P, and the first and second sensor devices 43, 44 are respectively adapted to detect each marker hole 41 with respect to those first and second speed sensing axes x1, x2. That is, the first and second speed sensing axes x1, x2 provide a reference axes for determining the position and/or the speed of the belt member 3 as it moves between the first and second positions A, B. The calibration system 40 further includes a processor 46 configure and arranged to process data or signals s1 provided by the sensor arrangement 42, and particularly from each of the first and second sensor devices 43, 44, to determine the position and/or speed of the conveyor body as it conveys the sheets along the transport path P. In this regard, because the distance X between the first position A and second position B is fixed and known, the detection of each uniquely identifiable marker hole 41 at each of the first and second positions A, B, combined with a timer in the sensor arrangement 42 or processor 46 to record a time of each detection, readily allows for calculation and determination of the actual belt member speed.

The calibration system 40 further comprises a rotary encoder 47 for converting a rotary position a of the non-driven fixed-axis roller 34 of the drive mechanism 32 to an electronic signal for correlation to a position and/or speed of the belt member 3. The encoder 41 generates a high-frequency signal s2 (e.g. 360 kHz) that correlates to the movement of the belt member 3 via a frequency multiplier unit 48. As effects described above, such as manufacturing tolerances, pollution, thermal effects and wear or deformation, cause discrepancies or errors between the encoded position of the roller 34 and the correlated position and/or speed of the belt member 3, the processor 46 in the calibration system 40 is configured to use data or signals s1 generated by the sensor arrangement 42 to correct or adjust a value of position and/or speed of the belt member 3 correlated from the encoder 47. The data or signals s1 generated by the sensor arrangement 42 are processed to provide a correction table for the position and/or speed of the belt member 3 correlated from the encoder 47. In other words, a measurement is performed with the first and second sensor devices 43, 44 of the sensor arrangement 42 to determine how many encoder pulses it takes for a particular marker hole 41 in the belt member 3 to travel from the first position A to the second position B, and to determine which encoder angle corresponds to that measurement. Thus, the processor 46 includes a correction table unit 49 for correcting the data or signals s2 from the rotary encoder 47 based on the data or signals s1 from the sensor arrangement 42.

The measurement of the position and/or speed of the belt member 3 performed by the first and second sensor devices 43, 44 is typically at a much lower frequency (e.g. 100 Hz) than the rotary encoder 47 provided in the drive mechanism 32 of the conveyor mechanism. That is, the measurement with the sensor arrangement 42 is performed with sub encoder resolution; for example, using a field-programmable gate array (FPGA). This way it is possible to very accurately measure movement the belt member 3 has made as a function of the encoder angle, independent of the belt velocity. As a discrepancy or error between the encoder measurements and actual movement of the belt member 3 typically only arises slowly, correction of any discrepancy or error can be performed via the sensor arrangement 42. The data or signals s1 from the sensor arrangement 42 can thus be used to calculate an encoder correction table online or continually. In this context, only the zero'th and first order harmonic of the encoder roller 34 are employed, and up to three full revolutions or circulations of the belt member 3 are used for the correction fit. This eliminates most of the measurement noise, resulting in a very accurate encoder table. To avoid introduction of errors by updating of encoder table, the frequency multiplier unit 48 is configured to only switch to an updated encoder table when the encoder 47 starts a new rotation. This process may be repeated periodically (e.g. every 6 seconds) so the encoder correction table unit 49 is updated to effectively suppress all slower disturbances.

Referring now to FIGS. 5 and 6 and FIGS. 9 and 10 of the drawings, the conveyor mechanism 2 further includes an adjustment system 50 for correcting skewing of the conveyor body or belt member 3 as it conveys the sheets S along the transport path P. The adjustment system 50 employs the markers 41 provided on or in the belt member 3 and the sensor arrangement 42 for detecting each marker 41 at the discrete first and second positions A, B spaced apart by the predefined distance X along the transport path P. In this regard, the first sensor device 43 includes a first skew sensing axis z1 and the second sensor device 44 includes a second skew sensing axis z2, with the first and second skew sensing axes extending generally parallel to the transport path P. In the context of the adjustment system 50, the first and second sensor devices 43, 44 are thus respectively configured to detect each marker hole 41 with respect to the first and second skew sensing axes z1, z2, as shown in FIGS. 7 to 10. A deviation δ of any one of the markers 41 with respect to the first or second skew sensing axes z1, z2 detected between first and second sensor devices 43, 44 is determined to represent a skewing of the belt member 3 between the first and second positions A, B.

As can be seen in FIG. 6, the conveyor belt member 3 and the drive mechanism 32 of the conveyor mechanism 2 are supported or mounted on a conveyor frame 36. The adjustment system 50 for correcting skewing of the conveyor belt member 3 includes a frame shifting device 51 for shifting or moving the conveyor frame 36 relative to a fixed framework (not shown) of the printing system 1. To this end, the frame shifting device 51 includes one or more actuator 52, such as a servo-motor, for driving movement of the conveyor frame 36, especially pivoting movement or rotational movement, to move the belt member 3 and indeed the entire conveyor mechanism 2 with respect to a reference axis 53. The shifting movement of the conveyor frame 36 to be carried out by the actuators 52 of the shifting device 51 is determined based command signals from the processor 46. That is, the processor 46 is configured to analyse data or signals s1 from the sensor arrangement 42 to detect or determine a degree or extent of skewing based on a deviation δ of any of the markers with respect to the first or second skew sensing axes z1, z2 between the first and second positions A, B. If skewing is detected, the processor 46 then is configured to control operation of the frame shifting device 51, and particularly the one or more actuator 52, based on the detected skewing to compensate or correct for that detected skewing in the belt member 3.

Figure 11:
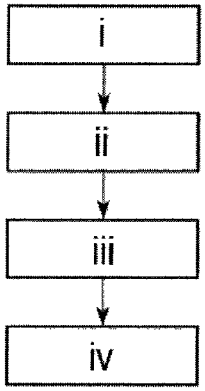
FIG. 11 is a flow chart showing an embodiment of a method of calibrating a sheet conveyor mechanism for conveying sheets along a transport path synchronised with a device for processing the sheets on the conveyor mechanism according to a preferred embodiment.

Referring to FIG. 11 of the drawings, a flow diagram is shown that schematically illustrates steps in a method of adjusting a sheet conveyor mechanism 2 of the preferred embodiment described above to correct skewing. In this regard, the first box i of FIG. 11 represents the step of providing one or more markers 41 on or in the conveyor belt member 3 distributed or spaced apart along a length of the belt member 3. In this regard, the markers 41 may be holes which are distributed or spaced apart along the extent of the conveyor belt member 3 at unique spacings so that each marker hole 41 is uniquely identifiable. The second box ii represents the step of sensing or detecting each marker 41 at two (first and second) discrete positions A, B spaced apart from one another by a predefined distance X along the transport path P. To this end, a sensor arrangement 42 is provided which comprises a first sensor device 43 arranged at a first position A for sensing or detecting each marker 41 and a second sensor device 44 arranged at a second position B for sensing or detecting each marker 41, with the first position A and the second position B spaced apart from one another by the predefined distance X. The third box iii represents the step of processing data or signals s1 provided or generated by the sensor arrangement 42 to detect and/or determine skewing of the conveyor body 3 as it conveys the sheets S along the transport path P. In this regard, the processing step comprises analysing the data or signals s1 from the sensor arrangement 42 to determine the skewing based on a deviation δ of any of the markers 41 with respect to a first or a second skew sensing axis z1, z2 of the first and second sensor devices 43, 44 between first and second positions A, B. The final box iv in drawing FIG. 11 then represents the step of moving a frame 36 of the conveyor mechanism 2 by pivoting or rotating the frame 36 about a reference axis 53 to correct the detected skewing.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 printing system
2 conveyor mechanism
3 conveyor body or belt member
4 first pre-treatment module
5 pre-treatment liquid applicator device
6 storage tank
7 roller
7' roller
8 dryer device
9 image forming device or inkjet marking module
90 inkjet nozzle
91 inkjet marking device
92 inkjet marking device
93 inkjet marking device
94 inkjet marking device
101 inkjet head
102 inkjet head
103 inkjet head
104 inkjet head
105 inkjet head
106 inkjet head
107 inkjet head
10 temperature control device
11 drying and fixing unit
20 apparatus
21 sentry unit
22 first sensor device
23 conveyor mechanism
24 controller
25 processing device
26 ejector device
27 reject tray
28 second sensor device
31 outer surface or carrier surface of belt member
32 drive mechanism
33 driven roller
34 non-driven, fixed-axis roller
35 biased roller
36 conveyor frame
40 calibration system
41 marker or hole
42 sensor arrangement
43 first sensor device
44 second sensor device
45 frame member
46 processor
47 encoder
48 frequency multiplier unit
49 correction table unit
50 adjustment system
51 frame shifting device
52 actuator
53 reference axis
d nozzle pitch
S sheet of print medium
P transport path or regular transport pat
P' alternative transport path
$P_S$ simplex transport path
$P_D$ duplex transport path
R printing range
O overlap of inkjet printer heads
D deformation or defect
A first position
B second position
X predefined distance
s1 data or signals from sensor arrangement
s2 data or signals from rotary encoder
x1 first speed sensing axis
x2 second speed sensing axis
z1 first skew sensing axis
z2 second skew sensing axis
α rotary position of the non-driven, fixed-axis roller
δ deviation or skewing

The invention claimed is:

1. A suction belt conveyor mechanism for conveying a plurality of sheets along a transport path in a printing system, wherein the conveyor mechanism comprises:

a movable endless suction belt member comprising perforations for communicating an under-pressure to an outer surface of the endless suction belt member on which the sheets are supported, wherein the under-pressure holds the sheets in a fixed position on the endless suction belt member as the endless suction belt member is moved to convey the sheets along the transport path;

a drive mechanism comprising a first roller and a second roller, which rollers support and drive a movement of the endless suction belt member to convey the sheets along the transport path; and an adjustment system configured to detect and correct skewing of the endless suction belt member as the endless suction belt member conveys the sheets along the transport path, the adjustment system comprising:

at least one marker provided on or in the endless suction belt member;

a sensor arrangement for detecting each marker at at least two discrete positions spaced apart from one another by a predefined distance along a length of the transport path, wherein the sensor arrangement comprises:

a first sensor device provided at a first position for detecting each marker; and a second sensor device provided at a second position for detecting each marker, wherein the first position and the second position are spaced apart from one another by the predefined distance in a transport direction of the transport path; and a processor for processing data provided by the sensor arrangement to determine the skewing of the endless suction belt member, wherein the first roller and the second roller of the drive mechanism are mounted on a movable conveyor frame, and wherein the adjustment system comprises a frame shifting device, the frame shifting device comprising at least one actuator for moving the moveable conveyor frame relative to a fixed framework, such that the endless suction belt member is moved to correct the detected skewing, wherein the at least one marker comprises a plurality of markers which are spaced apart along a length of the endless suction belt member, wherein each marker is fixed with respect to the endless suction belt member, and wherein each marker comprises its own characteristic form and/or each adjoining pair of said plurality of markers are spaced apart from one another along the length of the endless suction belt member at a unique spacing, such that each marker is uniquely identifiable by the sensor arrangement.

2. The suction belt conveyor mechanism according to claim 1, wherein the endless suction belt member is mounted on the movable conveyor frame.

3. The suction belt conveyor mechanism according to claim 1, wherein the at least one actuator is arranged for driving a pivoting or rotational movement of the conveyor frame with respect to a reference axis, such that the endless suction belt member is driven in a pivoting or rotational movement with respect to the reference axis.

4. The suction belt conveyor mechanism according to claim 3, wherein the at least one actuator is arranged for pivoting the conveyor frame with respect to the reference axis, wherein movement of the conveyor frame is determined based on the data from the sensor arrangement in relation to the detected skewing of the conveyor frame to correct for the detected skewing, and wherein the processor is configured to analyse the data from the sensor arrangement to determine the skewing based on a deviation of any of the plurality of markers with respect to a skew sensing axis and to control operation of the frame shifting device to correct the skewing by pivoting the conveyor frame to a required degree about the reference axis, when the processor has determined a skewing of the endless suction belt member based on a deviation of any of the plurality of markers with respect to the skew sensing axis.

5. The suction belt conveyor mechanism according to claim 1, wherein each marker preferably comprises an aperture in the endless suction belt member.

6. The suction belt conveyor mechanism according to claim 1, wherein the first position of the first sensor device and the second position of the second sensor device are provided on a frame member which provides the predefined distance, wherein the frame member is formed of a material substantially insensitive to temperature change.

7. The suction belt conveyor mechanism according to claim 1, wherein the first sensor device has a first skew sensing axis at the first position; and wherein the second sensor device has a second skew sensing axis at the second position, the first and second skew sensing axes extending generally parallel to the transport path, wherein the first and second sensor devices are respectively configured to detect each marker with respect to the first and second skew sensing axes.

8. The suction belt conveyor mechanism according to claim 7, wherein the processor is configured to determine a skewing of the endless suction belt member from a deviation of any of the markers with respect to the first or second skew sensing axes between the first and second sensor devices.

9. The suction belt conveyor mechanism according to claim 1, wherein the endless suction belt is substantially rigid.

10. The suction belt conveyor mechanism according to claim 9, wherein the endless suction belt is comprised of steel.

11. A printing system comprising the suction belt conveyor mechanism according to claim 1 for conveying sheets of print medium, wherein the adjustment system is configured to determine and correct skewing of the endless suction belt member which holds the sheets in an image forming device for printing an image on the sheets.

12. The mechanism according to claim 1, wherein a skew sensing axis of the sensor arrangement extends between the first and second positions, and wherein the processor is configured to analyze the data from the sensor arrangement to determine the skewing based on a deviation of any of the plurality of markers with respect to the skew sensing axis.

13. A method of adjusting a suction belt conveyor mechanism to correct skewing of a movable endless suction belt member which conveys sheets along a transport path, the conveyor mechanism comprising the endless suction belt member, the endless suction belt member comprises perforations for communicating an under-pressure to an outer surface of the endless suction belt member on which the sheets are supported, wherein at least one marker is provided on or in the endless suction belt member and distributed along a length of the endless suction belt member, a drive mechanism comprising a first roller and a second roller which rollers support and drive a movement of the endless suction belt member to convey the sheets along the transport path and a movable conveyor frame, wherein the first roller and the second roller of the drive mechanism are mounted on the movable conveyor frame, the method comprising the steps of:

conveying the sheets along the transport path via the endless suction belt member while providing the underpressure to the outer surface of the endless suction belt member to hold the sheets in a fixed position on the endless suction belt member;

sensing with a sensor arrangement each of the at least one markers at a first position positioned along the transport path;

sensing with the sensor arrangement each of the at least one markers at a second position positioned along the transport path, wherein the first position and the second position are spaced apart from one another by a predefined distance along a length of the transport path;

processing data provided by the sensor arrangement to determine a skewing of the endless suction belt member as it conveys the sheets along the transport path; and moving the conveyor frame with the first roller and the second roller by pivoting or rotating the frame about a reference axis, such that the endless suction belt member is moved to correct the detected skewing, wherein the at least one marker comprises a plurality of markers which are spaced apart along the length of the endless suction belt member, wherein each marker is fixed with respect to the endless suction belt member, and wherein each marker comprises its own characteristic form and/or each adjoining pair of said plurality of markers are spaced apart from one another along the length of the endless suction belt member at a unique spacing, such that each marker is uniquely identifiable by the sensor arrangement.

14. The method according to claim 13, wherein the endless suction belt member is further mounted on the movable conveyor frame.

15. The method according to claim 13, wherein the step of moving the conveyor frame comprises pivoting or rotating the conveyor frame with respect to a reference axis, such that the endless suction belt member is pivoted or rotated with respect to the reference axis.

16. The method according to claim 13, wherein the processing step comprises analysing the data from the sensor arrangement to determine the skewing based on a deviation of any of the markers with respect to a first or a second skew sensing axis of the sensor arrangement between the first and second positions.

17. The method according to claim 13, wherein the endless suction belt is substantially rigid.

* * * * *